US006701686B1

(12) United States Patent
Platt

(10) Patent No.: US 6,701,686 B1
(45) Date of Patent: Mar. 9, 2004

(54) CEILING GRID WITH SEAL

(75) Inventor: William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 10/346,039

(22) Filed: Jan. 16, 2003

(51) Int. Cl.[7] ..... E04B 5/52
(52) U.S. Cl. ..... 52/506.07; 52/731.7; 52/733.1
(58) Field of Search ..... 52/506.07, 731.7, 52/733.1

(56) References Cited

U.S. PATENT DOCUMENTS

| | | | | | |
|---|---|---|---|---|---|
| 2,964,148 | A | * | 12/1960 | Jacobson | 52/281 |
| 3,023,865 | A | * | 3/1962 | Brandstetter | 52/506.07 |
| 3,325,954 | A | * | 6/1967 | Olson | 52/302.1 |
| 3,969,865 | A | * | 7/1976 | Andersen | 52/506.07 |
| 4,232,081 | A | | 11/1980 | Pullan | |
| 4,339,860 | A | | 7/1982 | Hayashi | |
| 4,355,448 | A | | 10/1982 | Ezaki | |
| 4,432,166 | A | | 2/1984 | Weimar | |
| 4,611,444 | A | | 9/1986 | Nassof | |
| 4,800,681 | A | | 1/1989 | Skillen et al. | |
| 4,827,681 | A | | 5/1989 | Platt | |
| 4,830,898 | A | | 5/1989 | Smith | |
| 4,967,530 | A | | 11/1990 | Clunn | |
| 5,033,247 | A | | 7/1991 | Clunn | |
| 5,101,530 | A | | 4/1992 | Hansen et al. | |
| 5,174,065 | A | | 12/1992 | Schlicht | |
| 5,317,835 | A | | 6/1994 | Dupuy et al. | |
| 5,603,193 | A | * | 2/1997 | Koertge et al. | 52/506.07 |
| 6,523,314 | B1 | * | 2/2003 | LaLonde et al. | 52/506.07 |

* cited by examiner

*Primary Examiner*—Peter R. Brown
(74) *Attorney, Agent, or Firm*—Eugene Chovanes

(57) ABSTRACT

A beam for a suspended ceiling in a clean room has soft plastic flaps on top of the flanges. The flaps form a seal when a ceiling panel is supported on the beam. The flaps, formed continuously as the beam emerges from a roll forming operation, are integral with a plastic coating on the metal beam core.

11 Claims, 4 Drawing Sheets

CEILING GRID WITH SEAL

BACKGROUND OF THE INVENTION

1. Field of the Invention

The invention relates to a suspended grid ceiling, and particularly to such ceilings used in clean rooms and other closed environments.

2. The Prior Art

Suspended ceilings used extensively in building construction have a grid of intersecting beams suspended by wires from a structural ceiling. The grid supports panels laid in the grid openings.

The beams are generally formed of a web of flat steel roll formed into an inverted T. The panels are supported on the flanges of the T, with the hanging wires anchored above in the structural ceiling, and connected below to holes in the web of the beam.

The panels, and the upper side of the flanges of the beams, on which the panels rest, have relatively smooth surfaces so that they form a seal tight enough for virtually all ceiling installations.

However, the seal between the beam and the panel must be very tight in clean rooms such as operating rooms, and rooms for sensitive manufacturing operations, as well as rooms where the atmosphere is desirably contained, such as indoor swimming areas.

Various ways to form such very tight seals have been tried. One way was to adhesively apply foam strips to the upper sides of the flanges in the field. This is labor intensive, as each beam must be manually handled to apply the strip. Hold down clips compress the panel on the foam strips.

In another way, flexible tape has been used along the edges of the lower surface of the ceiling panels. This too is labor intensive as the edge of each ceiling panel must be taped manually prior to installation.

In still another way, an aluminum extruded inverted T-beam is used, that has a flat foam gasket applied at the factory. Such beam requires the beam to be specially extruded of aluminum, sometimes with a channel in the flange for the foam gasket, rather than being roll formed of relatively inexpensive steel by continuously passing a flat web of steel through successive rolls. In packing such beams having foam gaskets applied at the factory, the beams are laid in contact with with one another, side-to-side, in a packed container, such as a long cardboard box. The foam on a flange in such packed containers becomes compressed by the adjacent beam, and achieves a permanent set which then creates air leaks when the ceiling is constructed. Such a permanent set also occurs in other ways in beams that use foam gasketing material to seal. For instance, in a magnetic imaging room where heavy panels are inserted, the foam gaskets, with time, become set in a compressed state, and lose resiliency to compensate for any possible movement of the panels.

Other ways to create a seal between a panel and the supporting structure without foam gaskets have been attempted. One way has been to create a U-shaped edge cap around the panels with soft plastic fins extending downward, as in U.S. Pat. Nos. 4,967,530 and 5,033,247. Such an arrangement is labor intensive, since the edge cap must be applied to each panel individually.

In another way, channels in the horizontal flanges are filled with a jelly material. An L-shaped flange on the edge of the panel sinks into the jelly.

SUMMARY OF THE PRESENT INVENTION

The grid beam of the present invention, for a suspended ceiling, has a flexible flap of soft PVC plastic integrally extruded with a hard PVC plastic coating on a rolled steel inverted T-beam. The flexible flap of soft PVC forms a seal with a panel that is supported by the beam. The coating and flap, dually extruded, are continuously formed on the beam at a dual durometer coextrusion station, as the beam emerges from the roll forming operation. As well-known in dual extrusion, the soft PVC that forms the flexible flap is applied to the hard PVC coating while both are in the liquid state, so that the hard and soft PVC are integrally joined.

The dual extrusion compositions and methods used in the present invention are well-known in the prior art. Such methods and compositions are set forth, for instance, in the U.S. Patents cited below and incorporated herewith by reference.

When installed in the ceiling, the grid beam of the invention, before the panel is laid on the flange of the beam, has a resilient flap that extends, and is biased, upward and outward from the upper surface on the flange of the beam at each side of the web. The flap is in effect hinged to the hard plastic coating on the flange, and is integrally connected thereto.

When the panel is laid on a flange the flap yields but continues to be biased upwardly against the panel. Such upward bias of the relatively soft flap against the lower surface of the panel forms a tight seal with the panel, providing, in effect, a relatively airtight closure suitable for a ceiling requiring such tight seals.

DESCRIPTION OF THE PREFERRED EMBODIMENT

The suspended ceiling using the present invention is of the well-known type having a grid formed of intersecting main beams and cross beams. Such a ceiling and grid are shown, for instance, in FIG. 1 of U.S. Pat. No. 4,827,681, incorporated herein by reference. The inverted prior art T-beams primarily used in such grid are roll formed in the usual prior art way. A strip of flat sheet steel is fed through a series of roll forming stations to create the beam.

Figure 2:
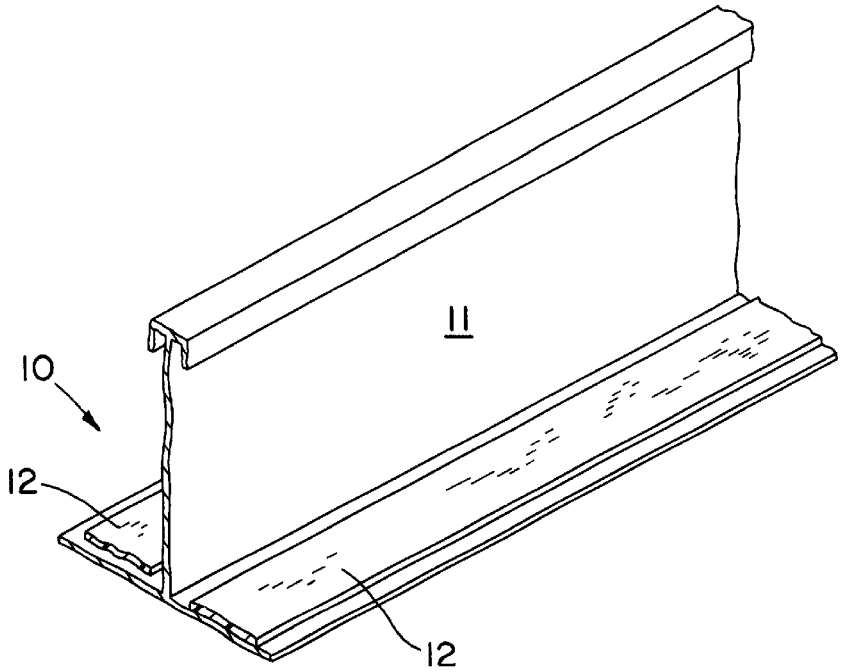
FIG. 2 PRIOR ART
FIG. 2 is a perspective view of a prior art grid beam having a foam gasket adhesively applied to the flanges.
Figure 3:
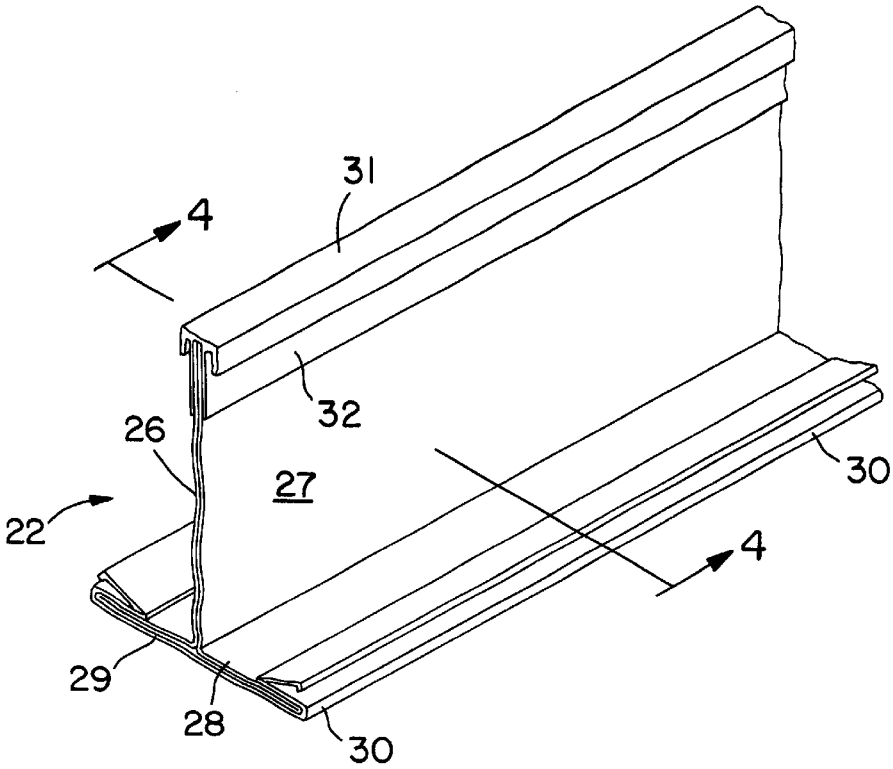
FIG. 3 is a perspective view of a segment of a beam of the invention.
Figure 4:
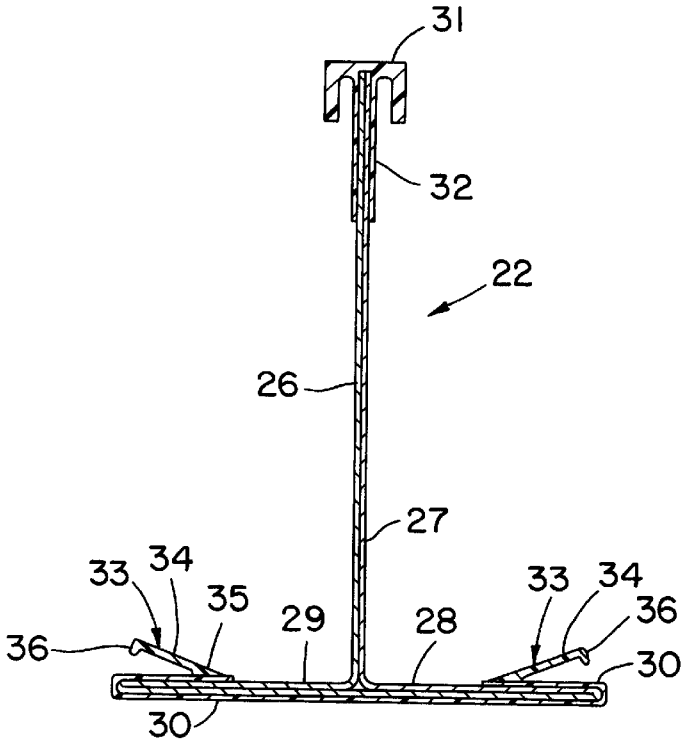
FIG. 4 is a cross-sectional view of the beam of the invention taken along the line 4—4 of FIG. 3.

In grids for prior art clean room, there has also been used, as seen in FIG. 2, a prior art beam 10 of extruded aluminum 11, having foam strips 12 adhered to the upper surface of the flanges. Such strip 12 was generally applied at the factory, after the beam 10 was extruded. A similar foam strip was also applied in the field, to grid beams formed of rolled flat steel. Whether the beam was extruded of aluminum, or roll formed from steel, the application of the foam strip was labor intensive, and, particularly when factory applied, created problems in storing and shipping the finished beam to avoid a set to the foam from a compressed state, as explained in the prior art section above.

Figure 1:
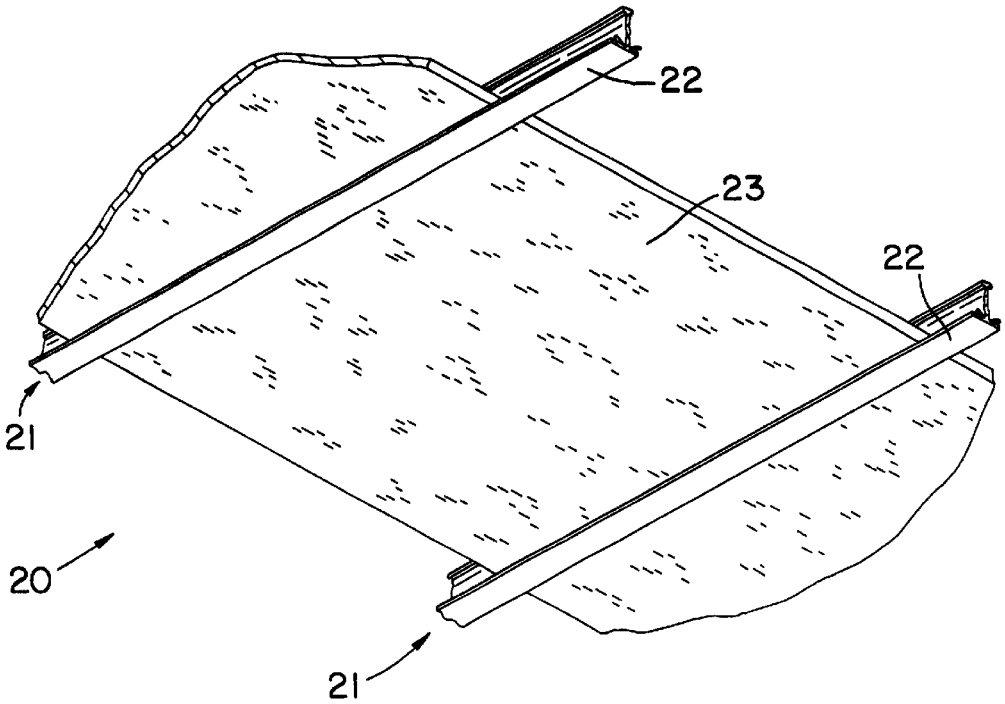
FIG. 1 is a perspective view, taken from below, of a segment of a suspended ceiling, with the cross beams not shown.

In FIG. 1, there is shown a segment of a suspended ceiling 20 using the grid 21 of the invention having grid beams 22 and panels 23 supported on the beams 22. In a ceiling installation, the beams 22 are supported by wires embedded in a structural ceiling at their upper end, and passed through holes in the webs of the beams at their lower end. The beams 22 form a grid 21 with rectangular openings of, for instance, 2'×2', or 2'×4', and a panel 23 is inserted in an opening and supported on all sides by the flanges of the grid beams 22. In FIG. 1, the cross beams that would support the panels 23 at their sides have been omitted to more clearly show the invention.

A core 26 in beam 22 of the invention is roll formed in the prior art manner by passing a strip of steel through roll forming stations, which continuously shape the steel strip into a T cross section having a web 27 and flanges 28,29 of a double thickness of the strip. A typical strip would be 0.022 inches thick, and would be of hot dipped galvanized steel produced by rolling.

The beam core 26 has a typical web 27 and flange 28,29 thickness of 0.045 inches. The flanges 27,28 have a combined width of 1.480 inches, across the flanges, and the web has a height of 1.960 inches.

To this beam core 26 of the beam, there is applied, as the core emerges from its final roll forming station and passes through a plastic extruding station, a coating 30 of a rigid plastic PVC material. The hard rigid coating 30, while soft when applied at a hot temperature to the metal flange, cools to a hard rigid state.

The hard rigid plastic coating 30 continuously applied to the flanges of the beam at the extruding station has a typical thickness of about 0.010 inches and is applied to the bottom surface of the flanges, around the edge of the flanges, and inward on each flange about 0.38 inches.

The extruded hard rigid PVC 30 is applied in a liquid state in a common prior art manner, for instance as disclosed in the patents cited below.

The construction of beam 22 of the invention utilizes techniques and compositions used, for instance, in the automotive industry to produce metal embedded extrusions, including trim sealing strips for automobile doors, windows, and luggage compartments. See U.S. Pat. Nos. 4,232,081; 4,339,860; 4,355,448; and 4,432,166; all of which are incorporated herewith by reference. Such strips include a metal embedded extrusion having a covering over a metal core, which in some instances is in the form of a binder coating, and sealing portions. The '166 patent discloses a dual extrusion process so as to have any desired different hardnesses between the covering portion and the sealing portion.

At the extruding station, while applying the hard rigid coating 30 to the flange, there is also applied a hard stiffener 31 of hard rigid plastic, of an inverted U-shape in cross section, to the top of the web 27.

Such stiffener 31 adds to the strength of the beam, and is a substitute for the prior art roll formed bulb.

The inverted U-shaped stiffener 31 is affixed to the top of the web 27 by side extrusions 32 that adhere to the top of the web 27, and are integral with the stiffener 31.

At the extruding station, with the coating 30 still hot and viscous, and before the coating 30 has cooled and the coating becomes hard and rigid, the beam 22 also has applied to it flaps 33 of a soft plastic PVC material extruded onto the flange coating 30 at the top of each flange (28,29). The soft PVC flaps 33 integrally bond with the hot viscous coating 30.

The flaps 33 are formed as shown in the drawings with an upwardly-inclined flat portion 34 joined to the flange coating 30 at 35 and then extending upward and outward at an incline. The flaps 33 have at their outer end a downwardly extending continuous bead 36.

When both the flange coating 30 and flap 33 have cooled and solidified after exiting the extrusion station, the continuous beam 22 is cut into suitable lengths, by, for instance, flying shears, and the necessary end connectors are applied, all in the well-known prior art manner.

In the field, the grid beams 22 of the invention are installed into a grid 21 for a suspended ceiling 20 in the conventional prior art manner, as shown, for instance, in the '681 patent referred to above.

After the grid 21 is in place, panels 23 are laid into the grid openings.

Figure 5:
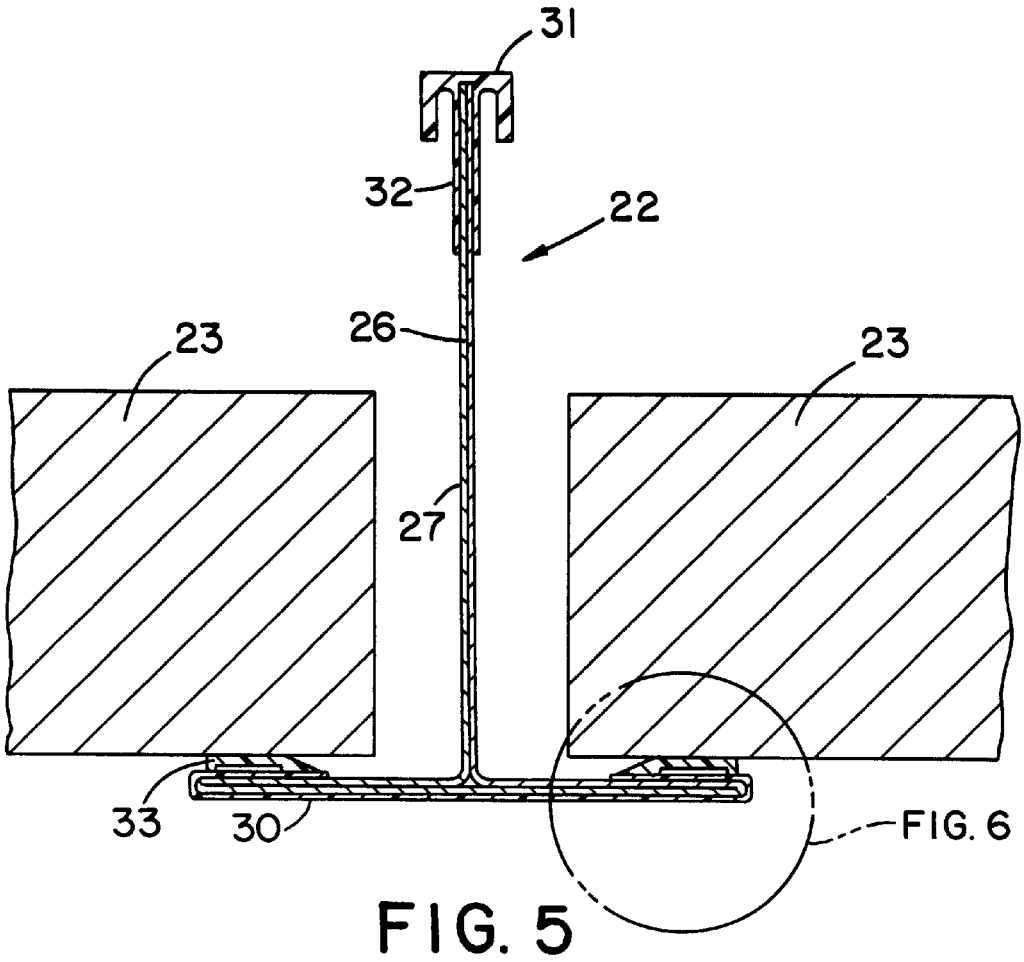
FIG. 5 is a cross-sectional view showing panels in a ceiling supported on a beam of the invention.
Figure 6:
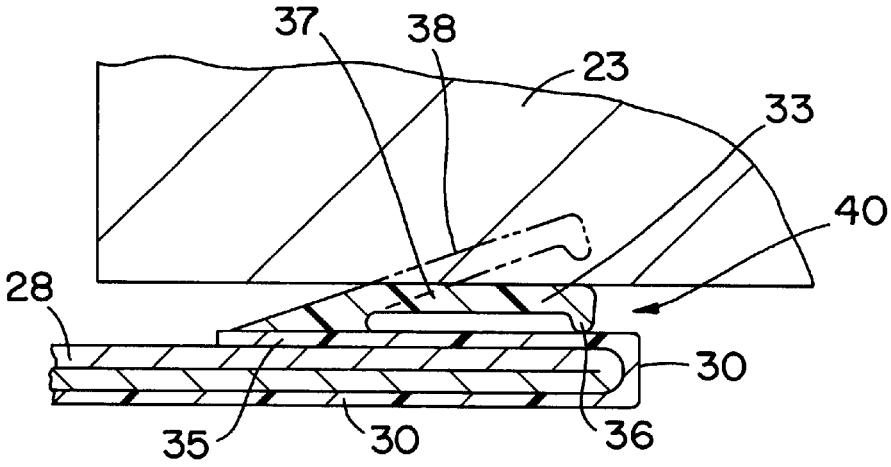
FIG. 6 is an enlarged view of the segment shown in FIG. 5 with a phantom view added of the flap on the beam in an extended position.

As seen in FIGS. 5 and 6, a panel 23 laid on top of the flange 28 causes flap 33 to yield to a sealing position 37. In such sealing position 37, the lower surface of the panel 23 rests on the top surface of the flap 33, causing the flap 33 to rotate to position 37 where bead 36 contacts the upper surface of flange 28. In this position, the flap 33 seeks to return to its unloaded position 38, pressing upward against the lower surface of panel 23. This creates seal 40 between the flap 33 and the lower surface of the panel 23, along the entire length of the beam 22, and entirely around the perimeter of the panel 23.

If the panel 23 is temporarily removed, as often occurs, to gain access to the space above the suspended ceiling 20, and then replaced, the flap 33 returns to its unloaded, upward position 38, until the panel 23 is replaced, after which the flap 33 will again acquire its sealing position 37.

Figure 7:
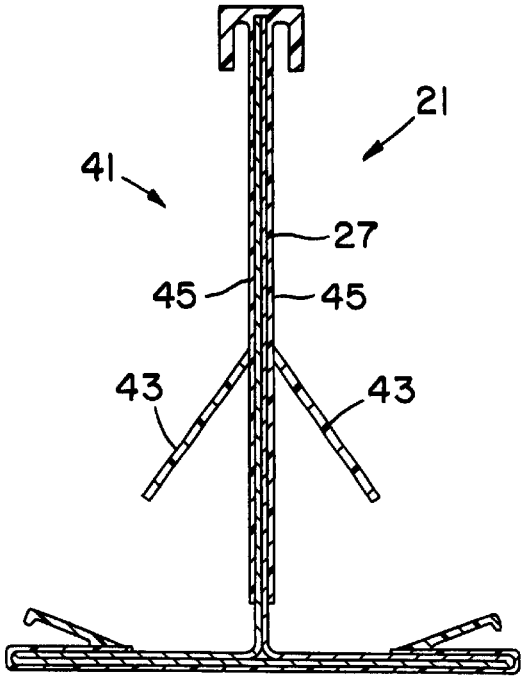
FIG. 7 is a view similar to FIG. 4 of an alternative embodiment of the invention in which soft flaps extend downwardly from the web of the beam.
Figure 8:
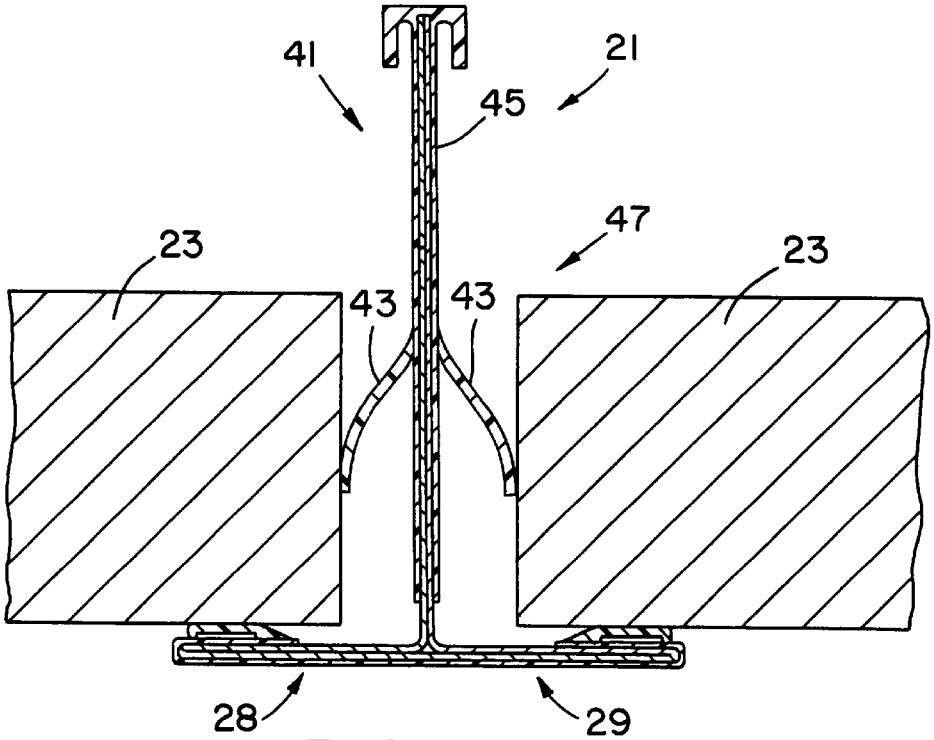
FIG. 8 is a view similar to FIG. 5 showing soft flaps extending from the web, bent, in contact with the ceiling panels.

In an alternative embodiment of the invention, beam 41, as seen in FIGS. 7 and 8, has flaps 43 of soft PVC that extend outwardly and downwardly from a coating of hard plastic or binder 45, applied to the web 27.

As with flaps 33 and coating 30, soft PVC for the flaps 43 is extruded onto hard PVC, or an equivalent binder, to form the coating 45, while the coating 45 is still hot and viscous, at the extruding station. The flaps are of a sufficient length and thickness to be biased outwardly, in a bent posture, as shown in FIG. 8, when panels 23 are seated on flanges 28,29. Such flaps 43, as seen in FIG. 8, provide an additional seal 47 between the grid beam 21 and ceiling tile 23 to that formed by flaps 33.

What is claimed is:

1. In a grid beam (22) for a suspended ceiling comprising a) an inverted T cross section of steel forming a core (26) having a web (27), and flanges (28,29) extending horizontally from the web (27);

the improvement comprising b) a coating (30) on the flanges (28,29); and, c) flaps (33) of soft flexible plastic integral with, and extending diagonally upwardly from the coating (30) on the flanges.

2. The beam 22 of claim 1, wherein the coating (30) is of a hard plastic.

3. The beam (22) of claim 1 or 2, wherein the flaps (33) have a bead (36).

4. The beam of claim 1 or 2, wherein the flaps (33) yield to form a seal (40) when a panel (23) is laid on the flange (28,29) of the beam (22).

5. The beam of claim 1 or 2, wherein the web (27) has a stiffener (31) of hard rigid plastic at the top thereof.

6. The beam of claim 1 or 2, in combination with flaps (43), integral with a coating (45) on the web (27) of the beam, extending diagonally outwardly from the web (27).

7. In a method of making grid beams (22) for a suspended ceiling (20) having an inverted T-shaped cross section with a vertical web and horizontal flanges extending outwardly from the web, a) continuously forming the beam (22) from a roll of flat steel through a series of roll stations, the improvement comprising as the beam continuously emerges from the roll forming stations, b) continuously forming, in an extrusion station, a coating (30) of plastic on the flanges (28,29) of the beam (22), c) continuously forming flaps (33), integral with the coating (30), on the upper surfaces of the flanges (28,29), in the extrusion station, of a plastic softer and more flexible than the coating (30).

8. The method of claim 7 wherein the coating (30) hardens after the flaps (33) are applied.

9. The method of claim 7, wherein the plastic is PVC.

10. The method of claim 7 wherein additional flaps (43) are formed on the web of the beam.

11. A grid beam (22) formed by the method of claim 7, 8, 9, or 10.

* * * * *